US006100863A

United States Patent [19]

Zhu

[11] Patent Number: 6,100,863

[45] Date of Patent: Aug. 8, 2000

[54] MOTION PIXEL DISTORTION REDUCTION FOR DIGITAL DISPLAY DEVICES USING DYNAMIC PROGRAMMING CODING

[75] Inventor: Daniel Qiang Zhu, Columbus, N.J.

[73] Assignee: Matsushita Electric Industrial Co., Ltd., Osakam, Japan

[21] Appl. No.: 09/052,775

[22] Filed: Mar. 31, 1998

[51] Int. Cl.[7] ..... G09G 3/36

[52] U.S. Cl. ..... 345/89; 345/63; 345/147

[58] Field of Search ..... 345/89, 60, 63, 345/147, 148

[56] References Cited

U.S. PATENT DOCUMENTS

| | | | |
|---|---|---|---|
| 5,196,839 | 3/1993 | Johary et al. | 345/148 |
| 5,436,634 | 7/1995 | Kanazawa . | |
| 5,638,091 | 6/1997 | Sarrasin | 345/148 |
| 5,731,802 | 3/1998 | Aras et al. | 345/148 |

FOREIGN PATENT DOCUMENTS

| | | |
|---|---|---|
| 766 222 A1 | 4/1997 | European Pat. Off. . |
| 833 299 A1 | 4/1998 | European Pat. Off. . |
| 2 74 253 | 4/1997 | France . |
| WO 90/12388 | 10/1990 | WIPO . |
| WO 94/09473 | 4/1994 | WIPO . |

OTHER PUBLICATIONS

S. Mikoshiba "Picture Quality Issues for Color Plasma Displays" The University of Electro–Communications, Japan (1995).

K. Toda et al. "An Equalising Pulse Technique for Improving the Grey Scale Capability of Plasma Display" Displays Euro Display '96 pp. 39–42.

Y.W. Zhu et al. A Motion–Dependent Equalizing–Pulse Technique for Reducing Dynamic False Contours on PDPs.

Nakamura T. et al. "Drive for 40 inch Diagonal Full Color AC Plasma Display" vol. XXVI, pp. 807–SID International Symposium Digest of Technical Papers, May 1995.

EPO Search Report, Oct. 20, 1998.

*Primary Examiner*—Dennis-Doon Chow
*Attorney, Agent, or Firm*—Ratner & Prestia

[57] ABSTRACT

A digital display device, such as a plasma display or a digital DMD based light digital project employs a minimum moving pixel distortion (MPD) set of codewords for reducing visually perceived artifacts viewed on a DDD, specially on a plasma display panel (PDP). The plasma display device includes a minimum MPD mapping process, which maps by, for example, a ROM look-up table, received pixel intensity values into intensity levels corresponding to selected ones of the set of codewords. By increasing the number of subfields (or rounding the least significant bits (LSBs) of the intensity pixels), redundant codewords that express pixel intensities can be generated based on the sustain pulse vector with predetermined constraints. An optimal set of codewords can be determined using a dynamic programming method which minimizes a measure of apparent error in a transition from a gray scale produced by one codeword to a gray scale produced by a next successive codeword. The optimal codewords are stored in a ROM lookup table as display data by a plasma display controller. The plasma display controller then provides the display data, line by line, to the plasma display panel (PDP) using a scan driver and a data driver. Once the display data is loaded into the PDP for an image, the plasma display controller enables the sustain pulse drivers to illuminate the addressed cells with the intended sustain pulse train encoded by the codeword.

8 Claims, 7 Drawing Sheets

MOTION PIXEL DISTORTION REDUCTION FOR DIGITAL DISPLAY DEVICES USING DYNAMIC PROGRAMMING CODING

FIELD OF THE INVENTION

The present invention related to any digital display devices which utilize pulse number (or pulse width) modulation techniques to express any gray-scale or color image in digital form, such as in the case of plasma display panels and DMD-based digital light projectors. More particularly, to a method for determining a minimum moving pixel distortion (MPD) code for above mentioned display devices.

BACKGROUND OF THE INVENTION

Plasma display panels normally use a binary-coded light-emission-period (discharge period) scheme for displaying digital images with certain gray-scale depth. For a typical 8-bit panel (8-bit system), there are $28^8$=256 possible intensity or gray-scale levels, To translate each data bit into a proper light intensity value on the screen, one TV frame period is divided into 8 subfield periods corresponding to bit 0 through bit 7 of a binary-coded decimal pixel intensity. The number of light-emission pulses (sustain pulses) of each discharge period for a cell in the panel varies from 1, 2, 4, 8, 16, 32, 64 to 128 for subfields 1 to 8 respectively. Although this binary-coded scheme is adequate for displaying still images, annoying false contours (contour artifacts) may appear in the image when either a subject within the image moves, or viewer's eyes move relative to the subject. This phenomenon is termed moving pixel distortion (MPD).

In order to address this problem, some systems employ MPD correction with equalization pulses. In this situation, the transition between subfields that may cause a contour artifact is detected and a light emission pulse is added or subtracted before the transition occurs. To date, these systems have only identified a few transitions for equalization. Furthermore, a sophisticated and costly motion estimator is needed to achieve motion-dependent equalization. Other systems may employ a modified binary-coded light-emission method to scatter the contour artifacts. By increasing the number of subfields from, for example, from 8 to 10 in a 8-bit panel, the method redistributes the length of the two largest light-emission blocks into four blocks with equal length (e.g., 64+128=48+48+48+48). To retain the same total number of pulses as used in the traditional system, the number of sustain pulses included in each of these four newly formed blocks is 48. The contour artifacts that may appear in this modified system are scattered through the image. The result is a more uniform temporal emission achieved by randomly selecting one of the many choices which have the same number of pulses for a given pixel value. When randomization is done at each pixel level, however, the contour artifacts may be transformed into moiré-like noise which, in some circumstances, may be a little bit less annoying to the viewer, This form of system only scatters the artifacts, it does not try to minimize them.

SUMMARY OF THE INVENTION

The invention is described in terms of an exemplary embodiment including a plasma display device. The plasma display device is used to serve as an example for disclosing the invention, The application of the current invention is independent of the particular type of a digital display device as long as it employs pulse number (or pulse width) modulation techniques to express any gray-scale or color image in digital form.

The present invention relates to a method for determining a set of codes used to display image data on a plasma display device with reduced moving pixel distortion (MPD). The method defines more than N subfields in order to represent $2^N$ gray scale levels. This results in some gray scale values being able to be represented by multiple subfield combinations, that is to say multiple code values. The method selects a particular set of code values to use based on the MPD that is likely to occur during certain gray scale value transitions when the code set is used. The method uses dynamic programming to select the set, Once the set has been selected, it is stored into a mapping memory. The mapping memory maps the intensity value of each respective pixel, as represented by an N-bit binary code, into a respective member of the selected set of minimum MPD codes, wherein at least one combination of subfield periods and respective illumination levels is defined for each one of the set of intensity values to form the set of minimum moving pixel distortion (MPD) codes so as to minimize moving pixel distortion on the display device between successive frames.

BRIEF DESCRIPTION OF THE DRAWINGS

These and other features and advantages of the present invention will become apparent from the following detailed description, taken in conjunction with the accompanying drawings, wherein.

DETAILED DESCRIPTION

General Description of Plasma Display Device

Figure 1:
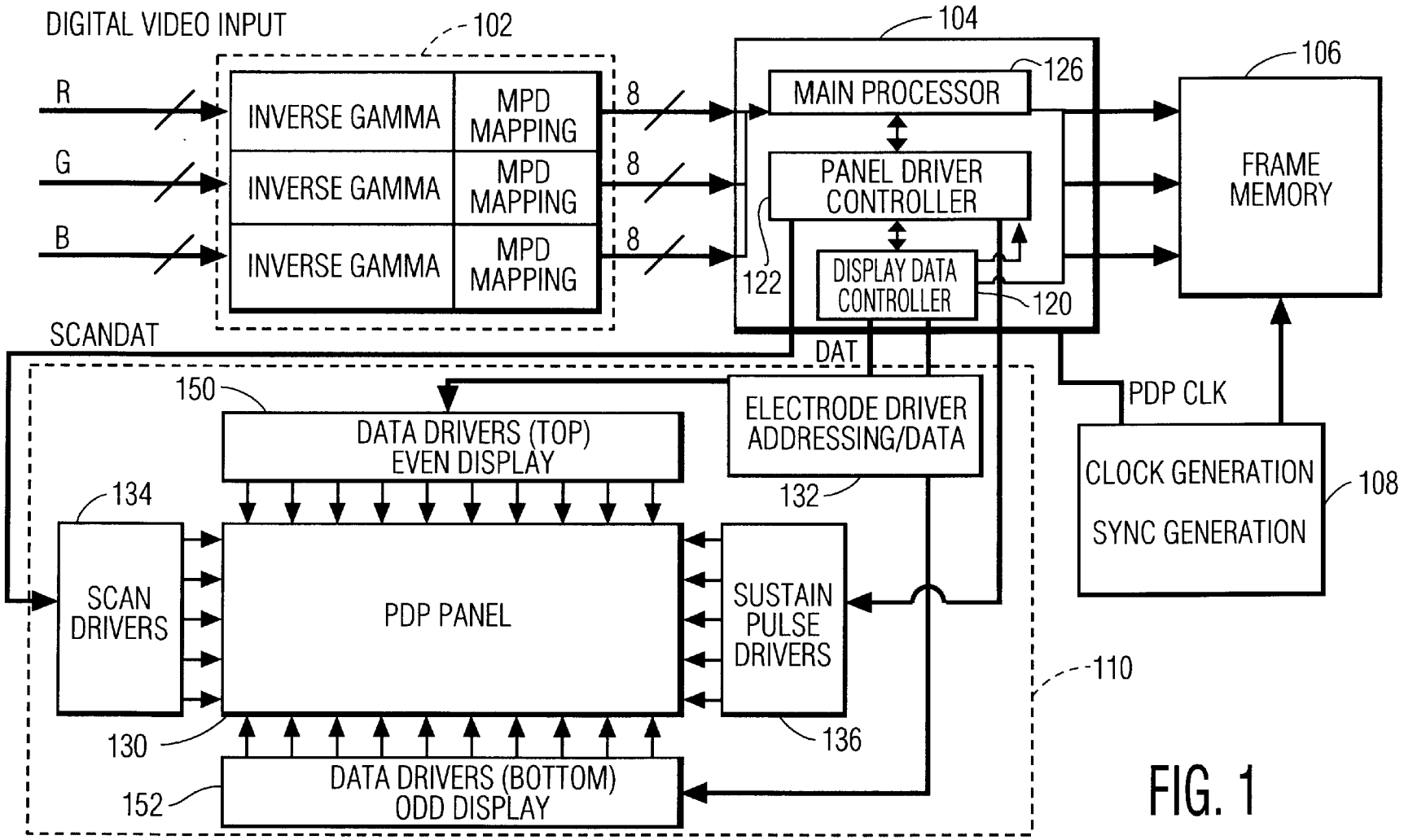
FIG. 1 is a high level block diagram of a simplified 8-bit plasma display device as is employed in one embodiment of the present invention.

FIG. 1 is a simplified block diagram of a plasma display device as is employed with one embodiment of the present invention. As shown, the plasma display device includes intensity mapping processor 102, plasma display controller 104, frame memory 106, clock and synchronization generator 108 and plasma display unit 110.

The intensity mapping processor 102 receives, digital video input, pixel by pixel, of a video image frame. The image frame may be of progressive format. For color images, the video input data for each pixel may consist of a Red intensity value, a Green intensity value and a Blue intensity value. For the sake of simplification, the following discussion only assumes one gray scale intensity value is being used. The intensity mapping processor 102 includes, for example, a look-up table or mapping table that translates the pixel intensity value to one of a group of intensity levels. Each one of the group of intensity levels is defined by a binary codeword, In the exemplary embodiment of the invention, each of tie red, green and blue pixel values is an eight-bit binary value. Each of these values is mapped into a 10, 11 or 12-bit code set which defines 256 brightness values. Because there are, for example, 4,096 12-bit code values, on the average, four of the 12 bit code values produce a single gray scale value. The invention described below selects 256 code values from the 4,096 code values to define a code set which spans the brightness variations that may be exhibited by the 265 input code values. These selected values define a code set which exhibits minimal moving pixel distortion (MPD).

The intensity mapping processor 102 may also include an inverse gamma correction sub-processor which reverses the gamma correction that was performed on the signal at the source. This gamma correction adjusts for nonlinearities in the reproduction of images on cathode ray tubes (CRTs). The exemplary plasma display device does not need gamma correction. Accordingly, the inverse gamma correction circuitry reverses the gamma correction algorithm that was applied at the signal source.

The frame memory 106 stores display data which is the intensity level for each pixel of a scan line for each line of an frame and a corresponding address for the plasma display unit 110 determined by the plasma display controller 104.

Figure 2A:
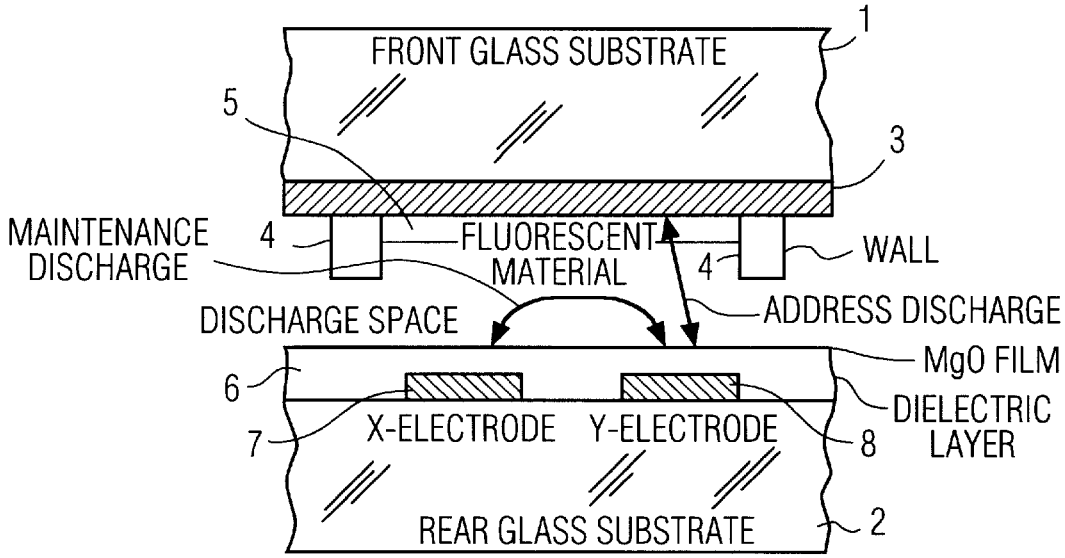
FIG. 2A PRIOR ART
FIG. 2A (Prior Art) is a side plan view of a single cell of a plasma display device which illustrates a cell arrangement of a three electrode surface discharge alternating current PDP as is used in an exemplary embodiment of the present invention.
Figure 2B:
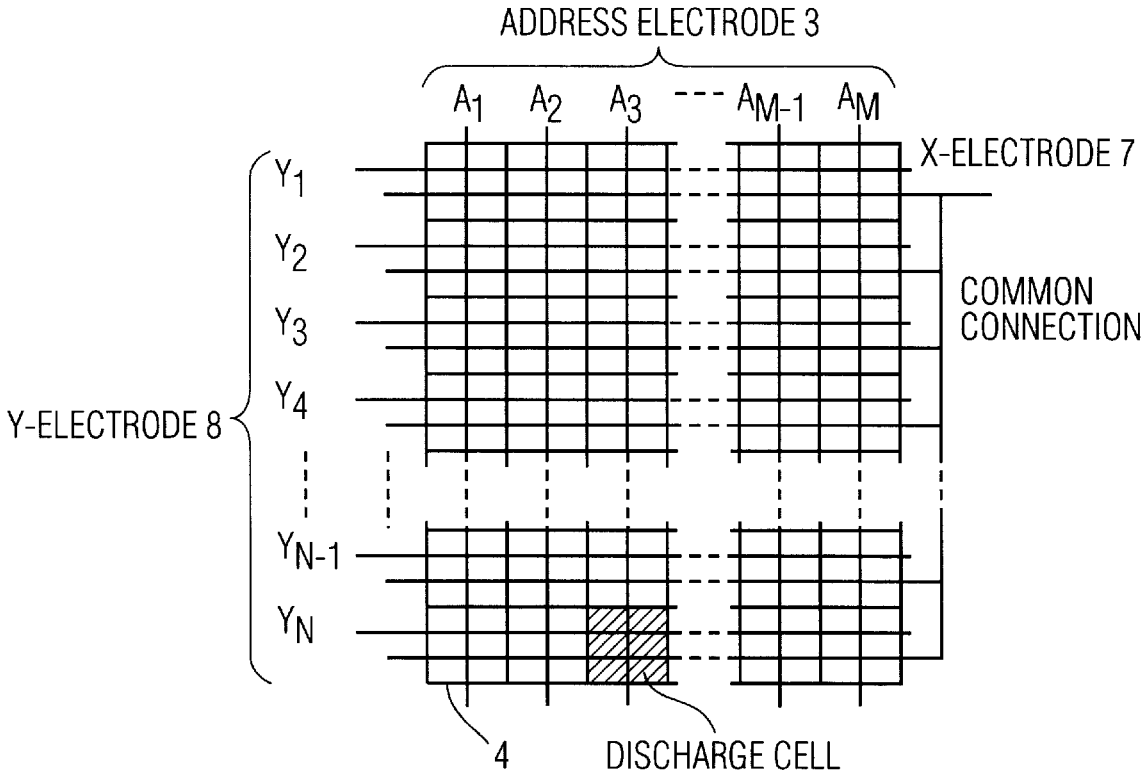
FIG. 2B PRIOR ART
FIG. 2B (Prior Art) is a partial top plan view of a plasma display which illustrates an M X N matrix of cells as illustrated in FIG. 2*a*.

The plasma display unit 110 further includes a plasma display panel (PDP) 130, an addressing/data electrode driver 132, scan line driver 134, and sustain pulse driver 136. The PDP 130 is a display screen formed using a matrix of display cells, each cell corresponding to a pixel value to be displayed. The PDP 130 is shown in more detail in FIG. 2*a* and 2*b*. FIG. 2*a* illustrates an arrangement of a three electrode surface discharge alternating current PDP 130. FIG. 2*b* shows the matrix formed by HxV cells.

As shown in FIG. 2*a*, each cell in the PDP 130 is formed between a front glass substrate 1 and a rear glass substrate 2. The cell includes an addressing electrode 3, an intercell barrier wall 4, and a fluorescent material 5, deposited between the walls. The PDP cell is illuminated by a potential established and maintained between an X electrode 7, the addressing electrode 4 and a Y electrode 8. The X and Y electrodes are covered by a dielectric layer 6. Light emission in the cell is established by an addressing electrical discharge between the addressing electrode and the Y electrode 8. The Y electrodes are scanned line by line while the addressing electrodes apply a potential to the cells on the line that are to be illuminated. The difference in potential between the Y electrode and the addressing electrode causes a discharge which establishes an electrical charge on the barrier walls of the cell, Light emission in a charged cell is maintained through application of sustain pulses (also known as sustain or maintenance discharges) between the X and Y electrodes. The sustain pulses are applied to all of the cells in the display but an illuminating discharge occurs only in those cells which have an established wall charge.

The addressing/data electrode driver 132 (shown in FIG. 1) receives the display data for each line of the scanned image from the frame memory 106. As shown, the exemplary embodiment includes addressing/data electrode driver 132 which may also include separate display data drivers 150 for the upper and lower portions of the display. By enabling the addressing/electrode driver 132 to process the upper and lower portions of the display separately, the time to retrieve and load data may be reduced. However, the present invention is not so limited, and a single addressing/data electrode driver 132 sequentially receiving data for the entire display may also be used, Display data consists of each cell address corresponding to each pixel to be displayed, and the corresponding intensity level codeword (determined by the intensity mapping processor 102).

The scan line driver 134, responsive to control signals from the plasma display controller 104, sequentially selects each line of cells corresponding to the scanning line of the image to be displayed. The scan line driver 134 works with the addressing/data electrode driver 132 to erase the wall charge from each cell and then selectively establish a wall charge on each cell that is to be illuminated. Each cell is either turned on or turned off. The relative brightness of a cell is determined by the amount of time in any field interval in which the cell is illuminated.

The sustain pulse driver 136 provides the train of sustain pulses for maintenance discharge corresponding to the selected display data value. As shown previously, the X electrodes of the PDP are tied together. The sustain pulse driver 136 applies sustain pulses for a period of time (maintenance discharge period) to all cells for all scan lines; however, only those cells which have a wall charge will experience a maintenance discharge.

The plasma display controller 104 further includes a display data controller 120, a panel driver controller 122, main processor 126 and optional field/frame interpolation processor 124. The plasma display controller 104 provides the general control functionality for the elements of the plasma display unit.

The main processor 126 is a general purpose controller which administers various input/output functions of the plasma display controller 104, calculates a cell address corresponding to the received pixel address, receives the mapped intensity levels of each received pixel, and stores these values in frame memory 106 for the current frame. The main processor 126 may also interface with the optional field/frame interpolation processor 124 to convert stored fields into a single frame for display.

The display data controller 120 retrieves stored display data from the frame memory 106 and transfers the display data for a scan line to the addressing/data electrode driver 132 responsive to a drive timing clock signal from the clock and synchronization generator 108.

The panel driver controller 122 determines the timing for selecting each scan line, and provides the timing data to the scan line driver 134 in concert with the display data controller transferring the display data for the scan line to the addressing/data electrode driver 132. Once the display data is transferred, the panel driver controller 122 enables the signal for the Y-electrodes for each scan line to ready the cell for the maintenance discharge.

To facilitate an understanding of the method of the present invention, the use of binary codewords for representing intensity levels of the pixels as is known in the prior art is now described.

Figure 3:
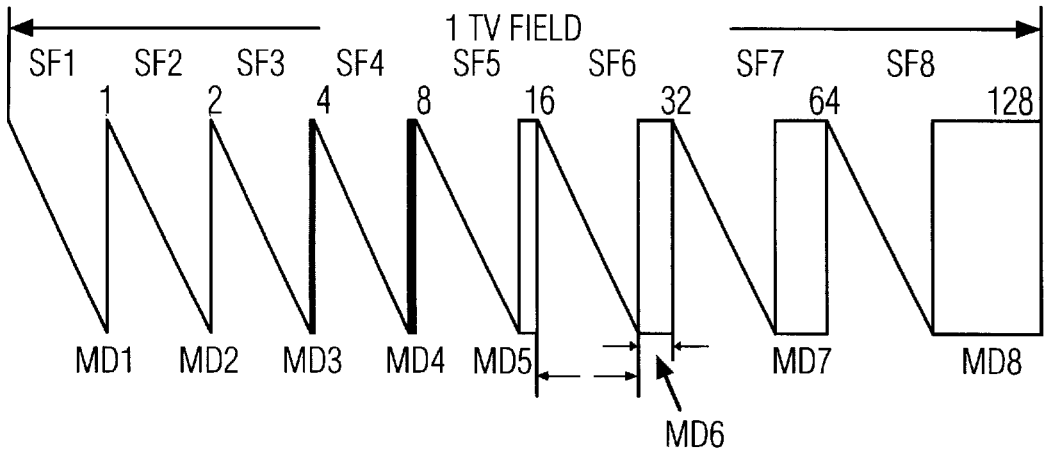
FIG. 3 (Prior Art) is a timing diagram which illustrates timing of a conventional PDP driving method employing binary codewords to achieve 256 intensity levels as is known in the prior art.

FIG. 3 illustrates the timing of a conventional PDP driving method employing binary codewords to achieve 256 intensity levels as is known in the prior art. The cell address and binary codeword value are stored in, and retrieved from, memory as display data, In FIG. 3, an image frame is divided into 8 subfields SF1 through SF8. The number of sustain pulses of each maintenance discharge period for a cell in the panel varies among 1, 2, 4, 8, 16, 32, 64, and 128 for subfields 1 to 8 respectively. Each subfield has a corresponding defined bit 0 through bit 7 of the pixel code word. Each subfield is divided into a fixed-length addressing period, AD (having a line sequential selection period, an erase period and a write period), and a maintenance discharge period, MD1 through MD8 in which sustain pulses are applied to the cell to emit light, As is shown, the ratio of the number of sustain pulses, $T_{Sus}$(SFi), i=1–8, for each of the discharge periods for this scheme is in a ratio of 1:2:4:8:16:32:64:128.

To display an image, the required level of intensity for each of the pixels in the image on a line by line basis is determined by the intensity mapping processor 102. The plasma display controller 104 converts the pixel address into a cell address, and converts the intensity level into a binary codeword value. As described previously, the binary codeword value is an 8 bit value, with each bit position in the 8-bit value enabling or disabling illumination during a corresponding one of the 8 subfields.

The subfield addressing operation begins with an erase discharge operation in which the wall charge on all cells in the line is erased. Each cell in the line is then selected to receive a wall charge based on the value of the bit in its corresponding intensity value that controls illumination during the corresponding subfield. Once all of the cells in the image have been addressed and appropriate wall charges have been established for a particular subfield period, the sustain pulses for the subfield are applied, and the cells having a wall charge are illuminated.

Figure 4A:
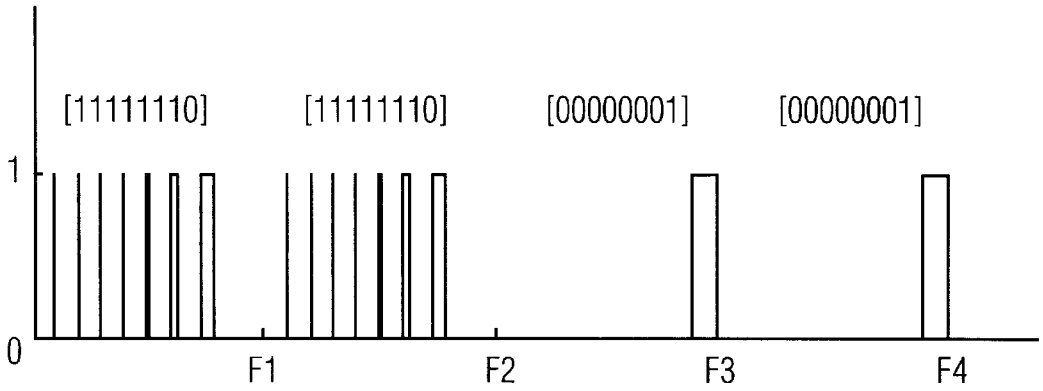
FIG. 4A is a timing diagram of a transition in an image which is useful for describing moving pixel distortion.
Figure 4B:
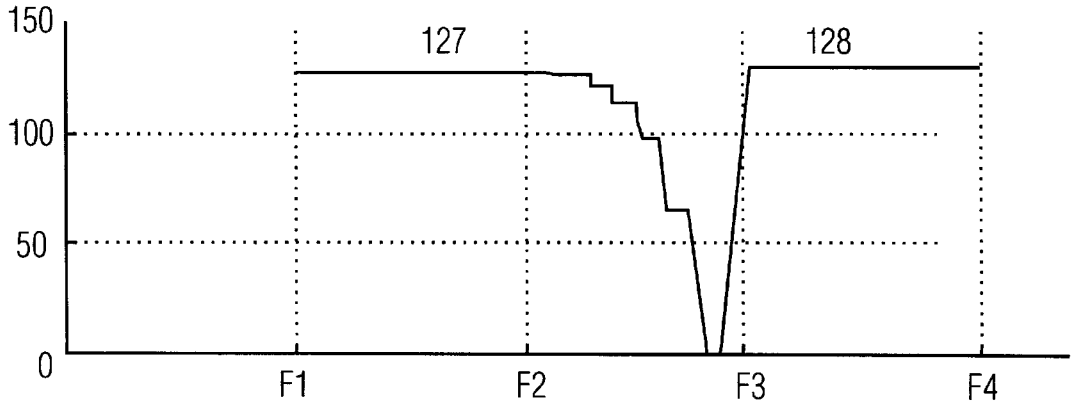
FIG. 4B is a graph of apparent intensity for the transition shown in FIG. 4A.

The binary-coded method described above is effective only when brightness variations occur quickly and are integrated into a single average brightness variation by the viewer's eyes. At least for certain transitions, however, the human eye does not integrate the changes in brightness causing annoying false contours to appear. These contours appear in moving images and in certain still images when the viewer scans across the image. This phenomenon is termed moving pixel distortion (MPD). A gray scale transition of a pixel from 127 to 128, for example, using the brightness mapping described above will trigger MPD due to the uneven temporal distribution of the sustain pulses. Because of human visual characteristics, the perceived intensity level for this transition is not sustained in the range of 127 or 128 but is reduced to a lower value, This is illustrated in FIGS. 4A and 4B. FIG. 4A shows the timing of sustain pulses for a single pixel over four fields, F1 through F4. FIG. 4B shows the apparent brightness of the pixel during the same interval. As shown in FIG. 4B, the large interval between the last sustain pulse in field F2 and the first sustain pulse in F3 is perceived as a momentary drop in brightness at the pixel position.

Selection of a Multibit Code Having Improved MPD Error Performance

The present invention selects a sustain pulse timing scheme which distributes the brightness levels produced by an N-bit code over M subfield intervals where M is greater than N. Although M subfields are defined, the sum of the sustain pulses in the M subfields is equal to $2^N-1$. In the exemplary embodiments of the invention, N is 8 and M is 10, 11 or 12. The selection method according to the present invention operates by defining a set of subfields for the $2^M$ code values which produces redundant brightness values, that is to say, a given brightness level is produced by more than one code value in the defined $2^M$ code set, The inventive method then uses dynamic programming to select individual code words from the code set such that MPD error between successive code values is minimized, A first step in this method is to define a model for the perceived intensity level at the retina, r(t). This approximation is given in equation 1.

$$r(t) = \int_t^{t+T} i(u)\,du \tag{1}$$

where T is one TV field period (normalized to 1023 time units). Note that the partial sum of i(t) over each subfield with the exact subfield boundary should yield the exact sustain period of that subfield. The partial sum of i(t) over each TV field with the exact field boundary should coincide with the expressed intensity level. It is contemplated, however, that other, more sophisticated retrieval models may be used.

As a practical model, a simplified time-varying rectangular impulse response for the retina is assumed in (1). The inventors have determined that this model provides sufficient accuracy for the MPD code selection method. It is contemplated, however, that other, more sophisticated retinal models may be used.

To calculate MPD error, it is desirable to have an ideal perceived intensity curve for a given transition, Although, this intensity curve should be a step function between the two transition levels, it is difficult to precisely define when during the interval between the two levels, the transition should occur. For this method, the error is defined as the minimum error between each of the two levels. Mathematically, the MPD mean-square-error (MSE), e, for the transition between gray scale level x and gray scale level y is defined by equation (2).

$$e = \frac{1}{T}\sqrt{\int_T \min\{e_1(t)^2, e_2(t)^2\}\,dt} \tag{2}$$

where $e_1(t)=|r(t)-x|$ and $e_2(t)=|r(t)-y|$.

Figure 5A:
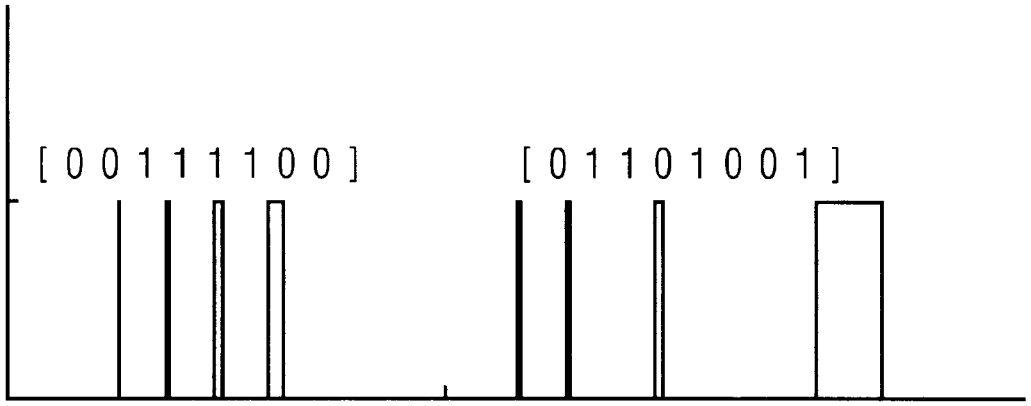
FIG. 5A is a timing diagram of a transition in an image which is useful for describing a method for measuring the MPD error resulting from a transition.
Figure 5B:
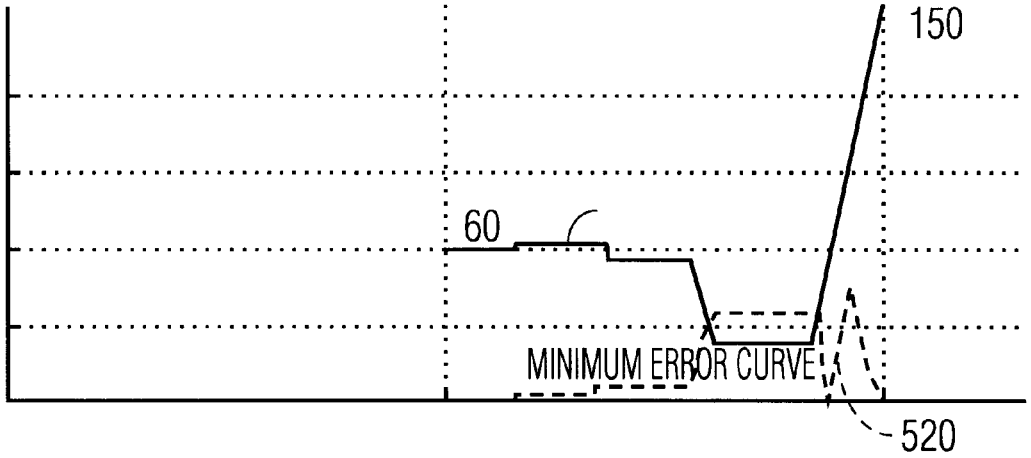
FIG. 5B is a graph of the apparent intensity for the transition shown in FIG. 5A including an indication of the measured MPD error.

FIGS. 5A and 5B show the minimum error curve for a transition between 60 and 150 using an 8-bit binary code. The solid-line curve 510 represents the perceived intensity as modeled by equation (1) and the dashed line curve 520 represents the MPD error (i.e. $\min(e_1(t),e_2(t))$ for the transition according to equation (2).

The inventors have determined several advantages for using the MPD MSE: first, there is no assumption of eye movement; second, the degree of MPD artifact translates into MPD MSE, that is to say, the bigger the MSE, the worse the MPD artifact; third, MPD MSE can be used as an objective function to find an effective MPD reduction scheme.

In the exemplary methods, more than N subfilelds arc defined to represent $2^N$ gray scale values. Accordingly, the sustain pulses may be distributed more evenly across the subfields. The sustain pulses can be distributed in many ways. It is, however, desirable for the assignment of sustain pulses among the M fields, SP([$sp_1$ sp . . . $sp_m$]) to satisfy two conditions set forth in equations (3) and (4).

$$\sum_{i=1}^{m} sp_i = 255 \tag{3}$$

$$x = [sp_1 sp_2 \ldots sp_m]\begin{bmatrix} c_1 \\ c_2 \\ \vdots \\ c_m \end{bmatrix}, \tag{4}$$

$$\forall\, x \in [0, 225] \text{ and } \forall\, c_i (i = 1, 2, \ldots, m) \in [0, 1]$$

The particular SP to be used is determined experimentally for given values of N-bit pixels being translated into M subfields. The inventors have determined that, for N=8 and M=10 an SP of [68 56 40 32 28 16 8 4 2 1] produces acceptable results, for N=8 and M=11, an exemplary SP is [56 48 41 34 27 21 8 4 2 1] and for N=8 and M=12, an exemplary SP is [48 43 37 32 27 22 18 13 8 4 2 1]. The selected SPs desirably exhibit a relatively even distribution of M-bit codes among the $2^N$ values of the input binary code.

The purpose of MPD coding is to decide which codeword to use to represent each brightness level given a prespecified SP, such that the overall MPD MSE is minimized. If $n_j$ is the number of codewords that represent the same gray-scale level, j, then the total number of codes, NCODES, that may be defined within any SP in which N=8, is given by equation (5).

$$NCODES = \prod_{j=1}^{255} n_j \tag{5}$$

Due to the large number of codewords, an exhaustive search is impractical. An alternative method is to use dynamic programming to identify a code which minimizes MPD MSE on single step transitions. Dynamic programming is described in chapter 8 of a text by F. S. Hillier and G. J. Lieberman entitled *Introduction to Operations Research* Holden Day, Inc, 1972, which is hereby incorporated by reference for its teachings on dynamic programming.

Figure 6:
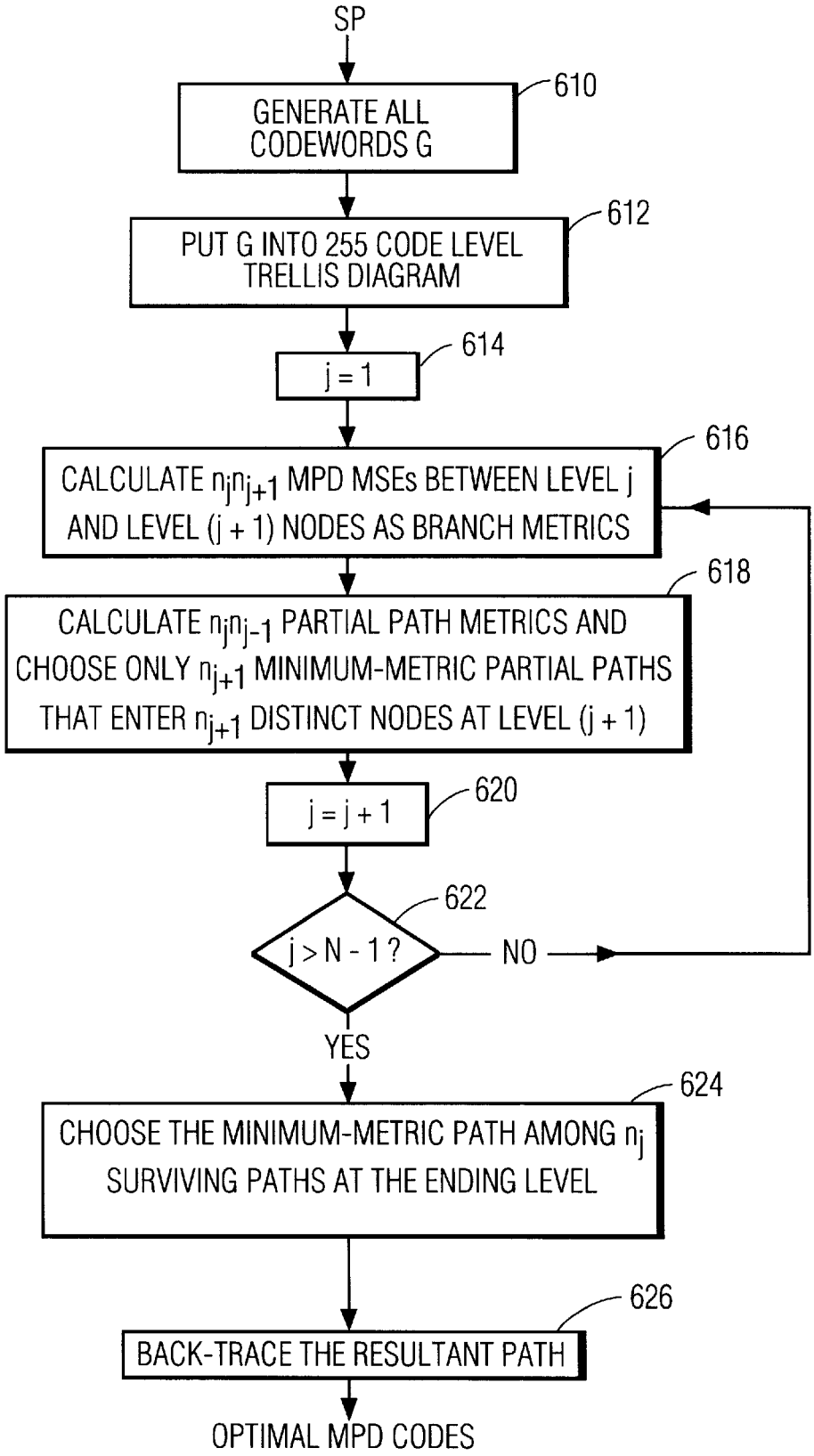
FIG. 6 is a flow-chart diagram of a method according to the present invention.

FIG. 6 is a flow-chart diagram of a code selection process in accordance with the subject invention, The first step in the process, step 610, generates all $2^M$ codewords for the SP. At step 612, the $2^M-1$ code words are arranged into the $2^N-1$ nodes of a trellis diagram. In the In the process according to the exemplary embodiment, N is 8 and M is 10, 11 or 12. For the case in which N is 8 and M is 12, 4,095 12 -bit code words are arranged in 255 columns. Only 255 columns are used because the representations of zero is unique for all SP. Accordingly, the representation of one can be used as a starting node and of zero can be eliminated.

Figure 7:
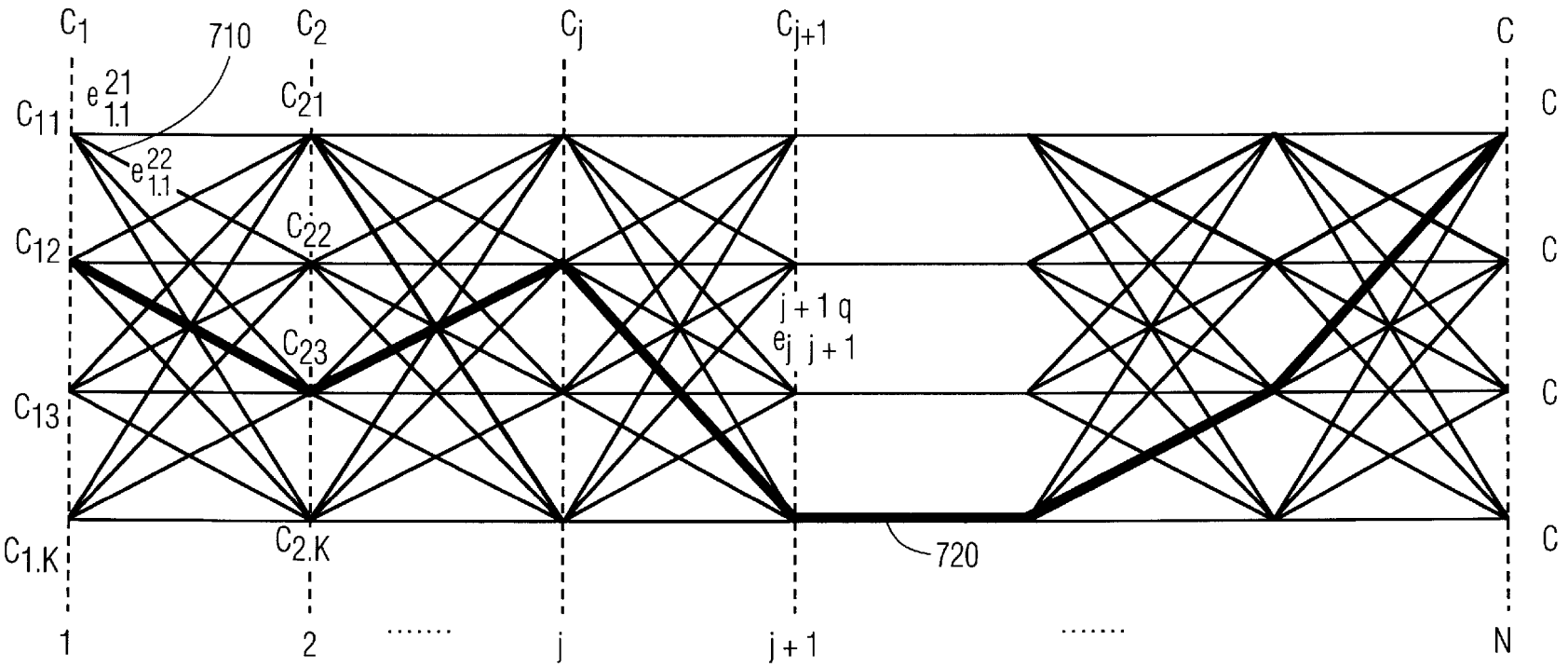
FIG. 7 is a one-step transition trellis diagram which is useful for describing the operation of the method shown in FIG. 6.

An exemplary trellis is shown in FIG. 7. In this trellis, all of the codes in a column or node have the same gray scale value when mapped into the SP. The columns of the trellis are labeled $C_1, C_2, \ldots C_j, C_{j+1}, \ldots C_{255}$. In general, the trellis has $2^N-1$ columns or nodes. The subscript indicates the gray scale value produced by the codes in the column. The individual codes in node j are labeled $C_{j1}, C_{j2}, \ldots, C_{jk}$. These are the k codes defined in the SP which have the gray scale value j. FIG. 7 shows several transitions between nodes 710. These transitions represent a transition from a code at one node, for example $c_{11}$, to a code at the next node, for example $c_{21}$. This transition generates an error according to equation (2). Using the notation of equation (2), this error is expressed in equation (2').

$$e_{11}^{21} = \frac{1}{T}\sqrt{\int_T \min\{e_{11}(t)^2, e_{21}(t)^2\}\, dt} \tag{2'}$$

where $e_{11}(t)=|r(t)-1|$ and $e_{21}(t)=|r(t)-2|$.

Returning to FIG. 6, after the code words have been assigned to the trellis at step 612, step 614 sets the loop variable j equal to 1, pointing it toward the first node in the trellis. Step 616 calculates the MPD MSE between each code at node j and each code at node j+1. Step 618 then computes the partial path metrics for each of the code values at the node and selects the minimum partial path metric for each code value in the node. The partial path metric may be, for example, a sum of the error from code $c_{j,x}$ to code $c_{j+1,y}$ and the minimum partial path metric that was determined for code $c_{j,x}$ where x represents each node at level j and y represents each node at level j+1. Thus, for each node at node j+1, there will be k partial path metrics if there are k codes in node j. Step 618 selects only the minimum partial path metric for each code at node j+1. Next, at step 620, j is incremented.

At step 620, j is compared to $2^N-1$. If J is less than $2^N-1$, then control is transferred to step 616 to calculate the minimum partial path metrics for the next node. If, at step 620, j is greater than $2^N-1$ then the metrics for each of the codes in the last node of the trellis have been calculated. At step 624, the process selects the smallest of the minimum metrics in the last node. This metric defines a path back through the trellis which includes one code value for each node. At step 626, this path is retraced and the code values are recorded. This code set is the one that is is selected by the process. The dark line 720 in FIG. 7 illustrates a path that retraces a minimum metric.

The code set that is selected in step 624 of the process shown in FIG. 6 has the minimum error between pairs of adjacent code values for any code that is defined in SP. Because the error for single gray scale steps is small, it follows that the error for steps of two or three gray scale values will also be small. Typically, errors in larger steps are less noticeable than errors in small steps. Consequently, the code set produced by the inventive method allows images to be reproduced with greatly reduced moving pixel distortion.

Figure 8:
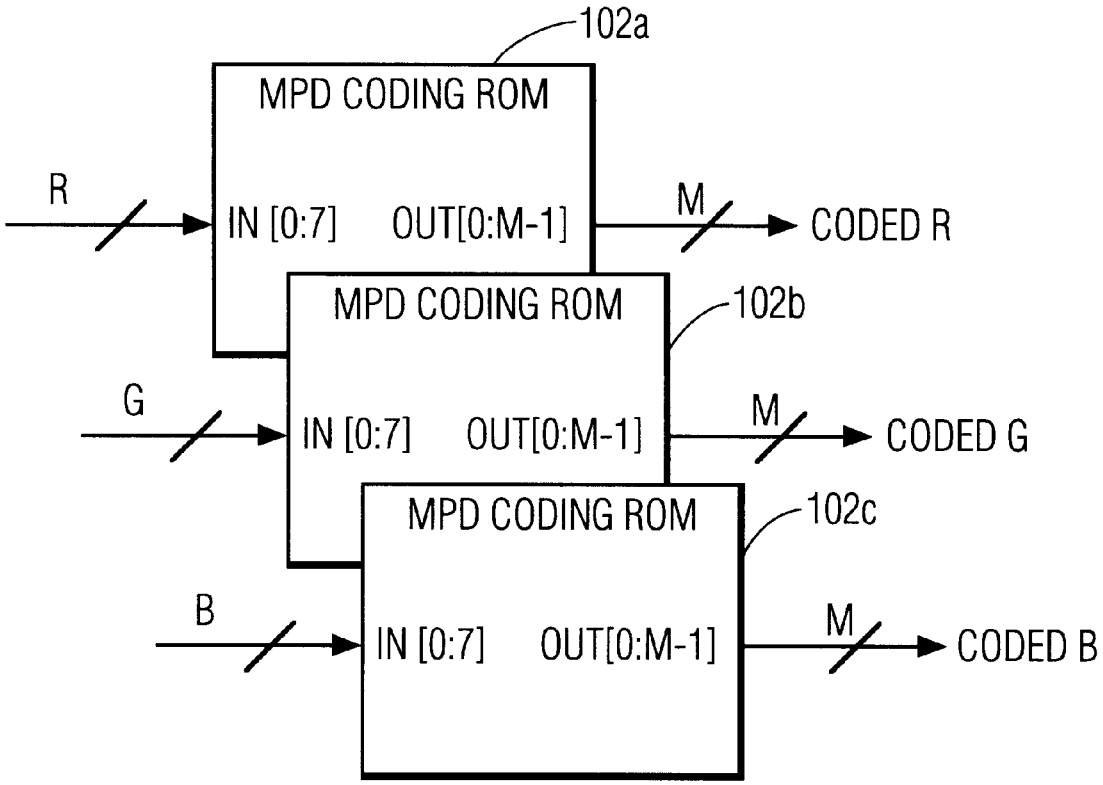
FIG. 8 is a block diagram of a pixel value translation memory which uses a minimum MPD code developed using the method shown in FIG. 6.

For a plasma display panel system, the code determined using the method shown in FIGS. 6 and 7 is burned into read only memories 102*a*, 102*b* and 102*c*, as shown in FIG. 8, which are then used to translate the received binary R, G and B signals into R, G and B signals that are coded for presentation on a plasma display panel.

The codewords found through dynamic programming are optimal only in the sense of achieving the overall minimum one-step transition MPD MSE, The codewords are in general not optimal with multiple-step transitions. To remedy this deficiency, the a modified branch metric, set forth in equation (6) may be used:

$$e'(c_{jpj}, c_{j+l,qj+l}) = \max\{e(c_{jp}, c_{jp}c_{j+l,q}) - d(j), 0\} \tag{6}$$

where $e(c_{jp}, c_{j+l,q})$ is defined in (2) and d(j) is a tolerance bias term which could be tuned to force some of the transitions having zero MSEs (or branch metric to be precise) and to admit larger MSEs as transition levels become larger. There are two immediate consequences after using this tolerance bias term, First, the MSEs of multiple-step transitions MSEs can be approximated as the sum of that of the corresponding single-step transitions, Since some do) may be adjusted such that $e(c_{jp},c_{j+l,q})-d(j)$ (and hence the branch metric $e'(c_{jp},c_{j+l,qj+l})$) is very close to zero, the multi-step transition MSEs is upper-bounded by the DP. Secondly, the tolerance bias term if set to be monotonically increasing penalizes more for MPD MSEs in darker areas of images than in brighter areas. This is appropriate because human eyes are more sensitive to MPD in darker scenes.

The other variations to the basic dynamic programming coding is that order of the gray-scale levels in the trellis doesn't have to be in ascending order, although in practice we haven't found a case that suggests a non-monotonic be preferred.

The exemplary embodiments of the present invention have been described with reference to a plasma display panel having a 10, 11 or 12-bit coding method. However, one skilled in the art would recognize that the invention may be extended to other systems, e.g. 4-bit or 8-bit systems with other subfields extensions and to other types of devices such as digital micromirror device (DMD) digital light projectors or other types of devices which use pulse number modulation or pulse width modulation.

While exemplary embodiments of the invention have been shown and described herein, it will be understood that such embodiments are provided by way of example only. Numerous variations, changes, and substitutions will occur to those skilled in the art without departing from the spirit of the invention, Accordingly, it is intended that the appended claims cover all such variations as fall within the spirit and scope of the invention.

What is claimed:

1. A method for determining a code set for use with a plasma panel display device which displays video images having $2^N$ gray-scale values, where N is an integer, the determined code exhibiting less moving pixel distortion (MPD) than a binary code which represents the $2^N-1$ gray-scale values as N-bit values, the method comprising the steps of:

defining M subfields where M is an integer greater than N;

allocating sustain pulses among the M subfields such that each of the $2^N-1$ gray scale values can be represented by a combination of selected ones of the M subfilelds;

defining $2^M-1$ code values as a sequence of M-bit binary values, each of the M bits corresponding to a respective one of the defined M subfields;

determining a gray scale value for each of the $2^M-1$ defined code values and grouping the $2^M-1$ code values according to gray scale value into $2^N1$ different groups;

determining an apparent error value between each code in group j and each code in group j+1 of the $2^N-1$ groups, where j is an integer; and determining the code set from among the grouped codes using a dynamic programming method which minimizes the determined apparent error as an objective function, the code set including one code selected from each group, the code set exhibiting a combined apparent error which is less than the combined apparent error of any other code set.

2. A method according to claim 1, further including the steps of:

storing the determined code set into a memory device such that the code value corresponding to a particular gray scale value is stored into a memory cell having a binary address which corresponds to the particular gray scale value; and applying N-bit binary values representing image pixels to an address input port of the memory to translate the N-bit binary values into M-bit binary values to drive the plasma panel display device.

3. A method according to claim 2, wherein the step of determining the apparent error value between each code in group j and each code in group j+1 includes the steps of:

selecting a first code from group j and a second code from group j+1;

modeling a retinal response to first and second sequences of the allocated sustain pulses, the first and second sequences corresponding to the first and second codes, respectively; and determining, as the apparent error value, a difference between the modeled retinal response and a transition from a first gray scale value, associated with group j, to a second gray scale value, associated with group j+1.

4. A method according to claim 3, wherein the step of determining, as the apparent error value, a difference between the modeled retinal response and the transition from the first gray scale value to the second gray scale value includes the steps of:

determining a difference in magnitude between the modeled retinal response and the first gray scale value as a first difference value;

determining a difference in magnitude between the modeled retinal response and the second gray scale value as a second difference value;

selecting one of the first and second difference values which is less than the other one of the first and second difference values; and integrating the selected difference value over an interval between occurrences of the first and second codes to produce the apparent error value.

5. A method according to claim 3, wherein the modeled retinal response is expressed by the equation:

$$r(t) = \int_t^{t+T} i(u)\,du,$$

where i(u) is a time-varying binary pulse train and T is one television field period.

6. A method according to claim 5, wherein the apparent error value between the first code, x, and the second code, y, is determined by the equation:

$$e = \frac{1}{T}\sqrt{\int_T \min\{(e_1(t))^2, (e_2(t))^2\}\,dt}$$

where $e_1(t)=|r(t)-x|$ and $e_2(t)=|r(t)-y|$.

7. A method according to claim 3, wherein the step of determining the code set from among the grouped codes using a dynamic programming method includes the steps of:

for each code in group 2 of the grouped codes, determining a minimum apparent error among value from among all of the determined apparent error values for the code and assigning the determined minimum error value as a path metric for the code in group 2;

for each code in group j+1, j being an integer greater than 1 and less than $2^N$, determining a minimum apparent error value from among all of the determined apparent error values for the code in group j+1 and combining the determined apparent error value for the code in group j+1 with the path metric for the code in group j which corresponds to the minimum error value to produce a path metric for the code in group j+1;

identifying a minimum path metric for all of the codes in group $2^N-1$ and determining from the identified minimum path metric, the one code from each group that generated the minimum path metric.

8. A method according to claim 1, wherein the plasma display device receives a plurality of binary-valued color video signals and the method further includes the step of:

storing the determined code set into plurality of memory devices, one memory device for each of the plurality of binary valued color signals; such that the code value corresponding to a particular gray scale value is stored into a memory cell of each of the memory devices which cell has a binary address that corresponds to the particular gray scale value; and applying the binary-valued color video signals to address input ports of the respective memory devices to translate the binary-valued color video signals into a respective plurality of M-bit binary values to drive the plasma panel display device.

* * * * *

UNITED STATES PATENT AND TRADEMARK OFFICE

CERTIFICATE OF CORRECTION

PATENT NO : 6,100,863

DATED : August 8, 2000

INVENTOR(S) : Daniel Qiang Zhu

It is certified that error appears in the above-identified patent and that said Letters Patent are hereby corrected as shown below:

In Column 9, line 48 "$2^N1$" should read --$2^N$-1--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*